US009478372B1

(12) United States Patent
Pierce

(10) Patent No.: US 9,478,372 B1
(45) Date of Patent: Oct. 25, 2016

(54) NORMALLY-OPEN SWITCH WITH POSITIVE STOPS FOR PREVENTING MOVEMENT OF THE STATIONARY CONTACT

(71) Applicant: E.M.B. Corporation, Elizabethtown, KY (US)

(72) Inventor: Anthony E. Pierce, Elizabethtown, KY (US)

(73) Assignee: E.M.B. Corporation, Elizabethtown, KY (US)

( * ) Notice: Subject to any disclaimer, the term of this patent is extended or adjusted under 35 U.S.C. 154(b) by 29 days.

(21) Appl. No.: 14/631,123

(22) Filed: Feb. 25, 2015

Related U.S. Application Data

(60) Provisional application No. 61/949,017, filed on Mar. 6, 2014.

(51) Int. Cl.
*H01H 1/26* (2006.01)
*H01H 13/52* (2006.01)

(52) U.S. Cl.
CPC ..... *H01H 13/52* (2013.01)

(58) Field of Classification Search
CPC ..... H01H 1/26; H01H 1/30; H01H 1/34; H01H 5/18; H01H 3/12; H01H 3/52; H01H 11/0012; H01H 13/36; H01H 2001/265; H01H 2001/247
USPC ..... 200/271, 245–247, 535, 283, 6 C
See application file for complete search history.

(56) References Cited

U.S. PATENT DOCUMENTS

| | | | | |
|---|---|---|---|---|
| 3,809,834 A * | 5/1974 | Hipple | H01H 13/36 200/452 |
| 4,902,863 A * | 2/1990 | Fukuma | H01H 13/28 200/445 |
| 2014/0042006 A1* | 2/2014 | Lin | H01H 13/42 200/535 |

* cited by examiner

*Primary Examiner* — Vanessa Girardi
(74) *Attorney, Agent, or Firm* — Stites & Harbison, PLLC; David W. Nagle, Jr.; James R. Hayne

(57) ABSTRACT

A normally-open switch comprises: a housing; a push button that is mounted for movement with respect to the housing; a stationary terminal; a moveable terminal that, when in contact with the stationary terminal, completes a circuit; and one or more positive stops that engage the stationary terminal. When a force is applied to the push button, the moveable terminal makes contact with the stationary terminal, thus closing the circuit. When the force is removed, the moveable terminal breaks contact with the stationary terminal, thus opening the circuit. The one or more positive stops apply pressure to and maintain a predetermined position of the stationary terminal, but do not interfere with or impede the moveable terminal.

15 Claims, 7 Drawing Sheets

(BOTTOM VIEW)

(BOTTOM VIEW)

NORMALLY-OPEN SWITCH WITH POSITIVE STOPS FOR PREVENTING MOVEMENT OF THE STATIONARY CONTACT

CROSS-REFERENCES TO RELATED APPLICATIONS

The present application claims priority to U.S. Provisional Patent Application Ser. No. 61/949,017 filed on Mar. 6, 2014, the entire disclosure of which is incorporated herein by reference.

The present application also is directed to similar subject matter as commonly assigned U.S. patent application Ser. No. 14/185,625 filed on Feb. 20, 2014 (now U.S. Pat. No. 9,218,926), which itself claims priority to U.S. Provisional Patent Application Ser. No. 61/787,830 filed on Mar. 15, 2013, the entire disclosures of which are incorporated herein by this reference.

The present application also is directed to similar subject matter as commonly assigned and co-pending U.S. patent application Ser. No. 14/631,226 entitled "Double-Throw Switch with Positive Stops" and filed on the same date as the present application, which itself claims priority to U.S. Provisional Patent Application Ser. No. 61/948,992 filed on Mar. 6, 2014, the entire disclosures of which are incorporated herein by this reference.

BACKGROUND OF THE INVENTION

Many devices utilize a normally-closed or normally-open switch. Such switches often have a push button that is biased into an extended position. When the push button is in the extended position, the switch is in its normal state. For a normally-closed switch, the circuit is closed in its normal state with a moveable terminal in contact with a stationary terminal. For a normally-open switch, the circuit is open in its normal state with a moveable terminal disengaged from a stationary terminal. As a force is applied to the push button, the push button rotates into the housing of the switch. Such rotation of the push button causes the moveable terminal to move relative to a stationary terminal. In a normally-closed switch, this movement causes the moveable terminal to break contact with the stationary terminal, thus opening the circuit. Conversely, in a normally-open switch, this movement causes the moveable terminal to make contact with the stationary terminal, thus completing the circuit.

One problem that commonly occurs with such normally-closed switches is that, in some cases, the circuit never opens. For example, many refrigerators and freezers have an interior light that is off when the door is closed, but is on when the door is open. To turn such a light on or off in response to the movement of the door, a normally-closed switch is commonly installed near the door of the refrigerator or freezer. However, improper installation of the switch can lead to the circuit not opening, especially when there is a lack of quality control by the manufacturer with respect to ensuring the correct gap between the liner and the door relative to the switch location. Further compounding this problem, when the internal post member moves downward and causes the moveable terminal to break contact with the stationary terminal, it has also been observed that there is often some slight movement of the stationary terminal. In other words, the stationary terminal may move with the moveable terminal to some extent, resisting the disengagement of the moveable terminal from the stationary terminal.

Commonly assigned and co-pending U.S. patent application Ser. No. 14/185,625 describes a solution to this problem. In U.S. patent application Ser. No. 14/185,625, which again is incorporated herein by reference, the normally-closed switch further includes one or more positive stops engaging the stationary terminal at a predetermined position in the movement of the stationary terminal. Thus, the stationary terminal is prevented, at a given point, from any further movement with the moveable terminal, at least beyond the predetermined position. In other words, the positive stops substantially eliminate any resistance to the disengagement of the moveable terminal from the stationary terminal. And, as a result, the normally-closed circuit opens and closes more consistently.

There remains a need for an improved construction for such a normally-open switch that similarly ensures that the circuit opens and closes more consistently.

SUMMARY OF THE INVENTION

The present invention is a normally-open switch with positive stops.

A normally-open switch made in accordance with the present invention includes a housing that defines an internal cavity in which the internal components of the switch are housed, and the switch further includes a push button that is mounted for movement with respect to the housing. When the push button is in an extended position, a moveable terminal is disengaged from a stationary terminal, so the circuit is open. However, when a force is applied to the push button, the push button rotates into the housing about a pivot axis. Such rotation of the push button forces an internal post member, which extends between the push button and the moveable terminal, to move downward. As it moves downward, the distal end of the internal post member engages and applies pressure to the moveable terminal, causing the moveable terminal to make contact with the stationary terminal, thus closing the circuit. Once the force is no longer applied to the push button, the push button returns to the extended position, and the moveable terminal breaks contact with the stationary terminal. In this regard, the moveable terminal has sufficient resilience that it also functions like a leaf spring, providing a biasing force against the internal post member that returns the push button to the extended position.

The normally-open switch further includes one or more positive stops engaging the stationary terminal at a predetermined position in the movement of the stationary terminal. Thus, the stationary terminal is prevented, at a given point, from any further movement with the moveable terminal, at least beyond the predetermined position. In other words, the positive stops substantially eliminate any resistance to the disengagement of the moveable terminal from the stationary terminal. And, as a result, the normally-open circuit opens and closes more consistently.

DETAILED DESCRIPTION OF THE INVENTION

The present invention is a normally-open switch with positive stops.

Figure 1:
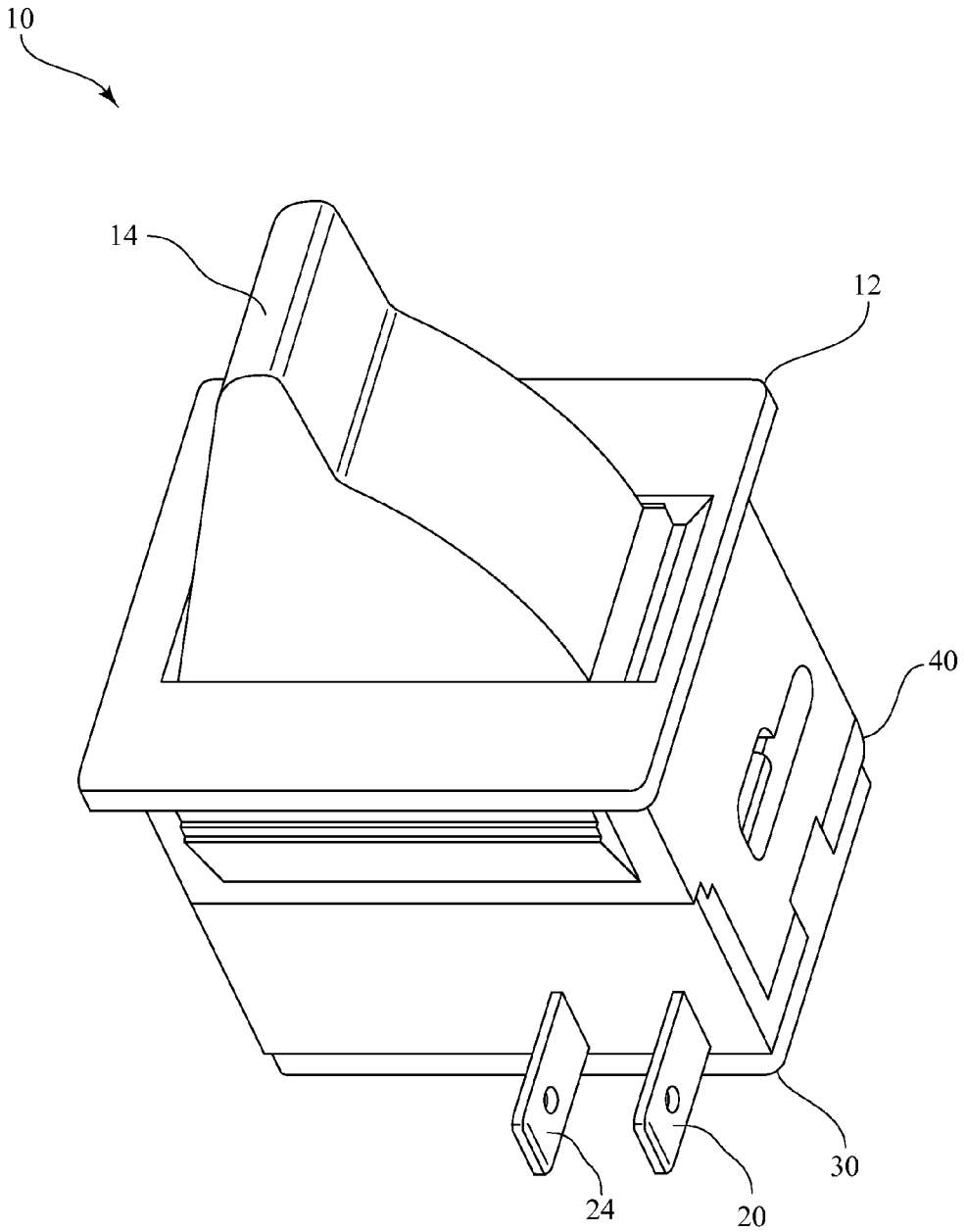
FIG. 1 is a perspective view of an exemplary normally-open switch made in accordance with the present invention.
Figure 2:
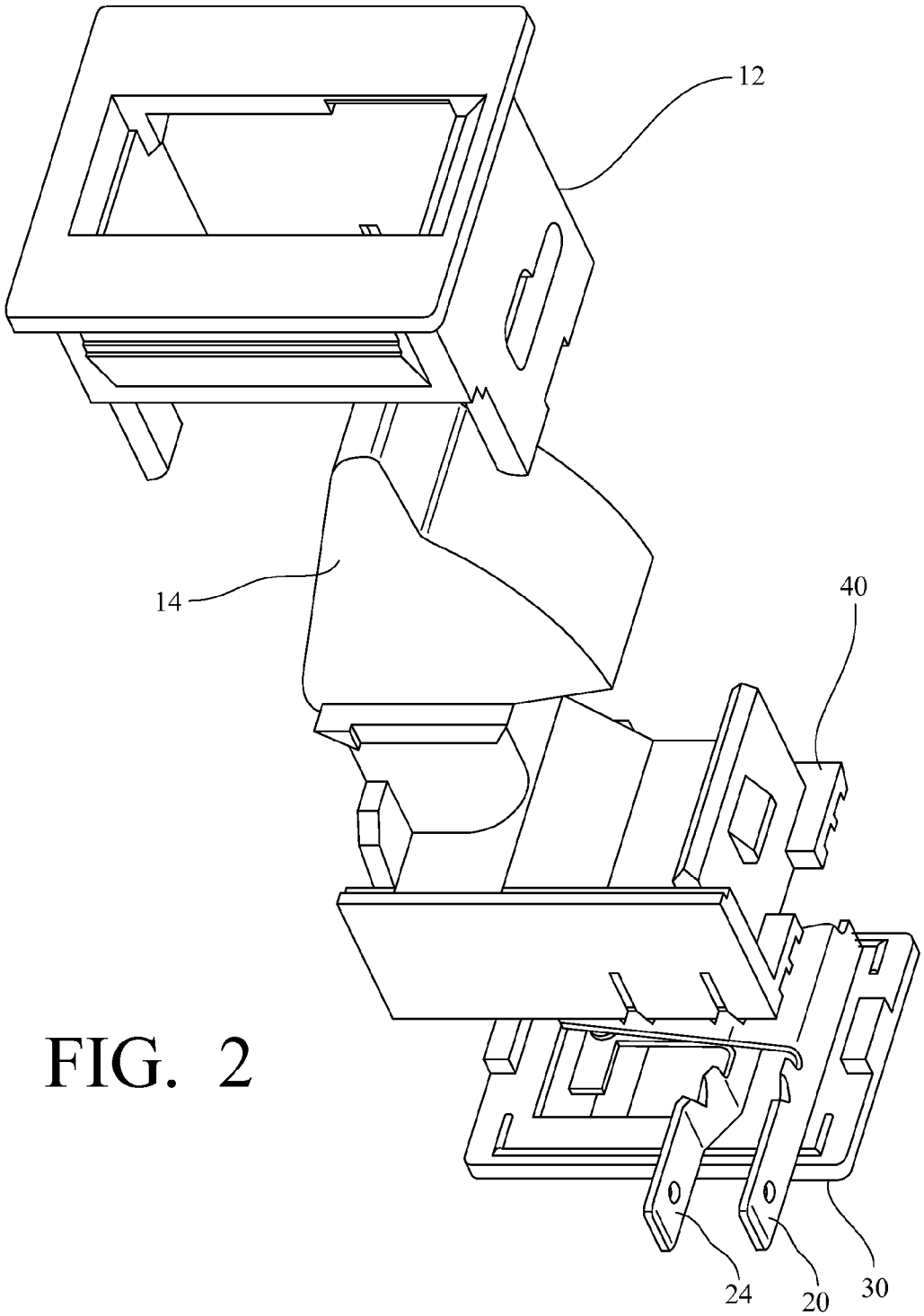
FIG. 2 is an exploded perspective view of the exemplary normally-open switch of FIG. 1.
Figure 3:
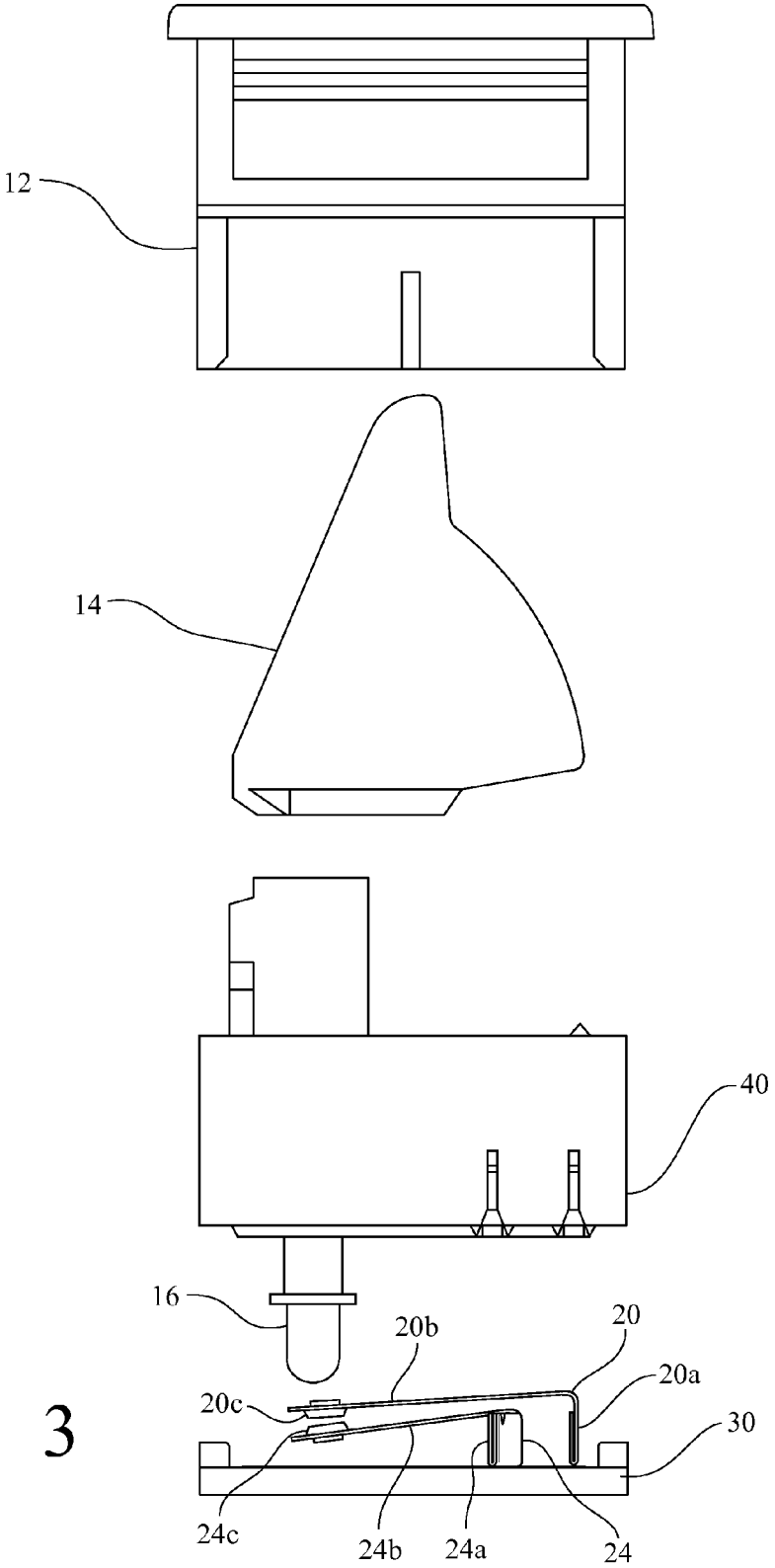
FIG. 3 is an exploded side view of the exemplary normally-open switch of FIG. 1.
Figure 4:
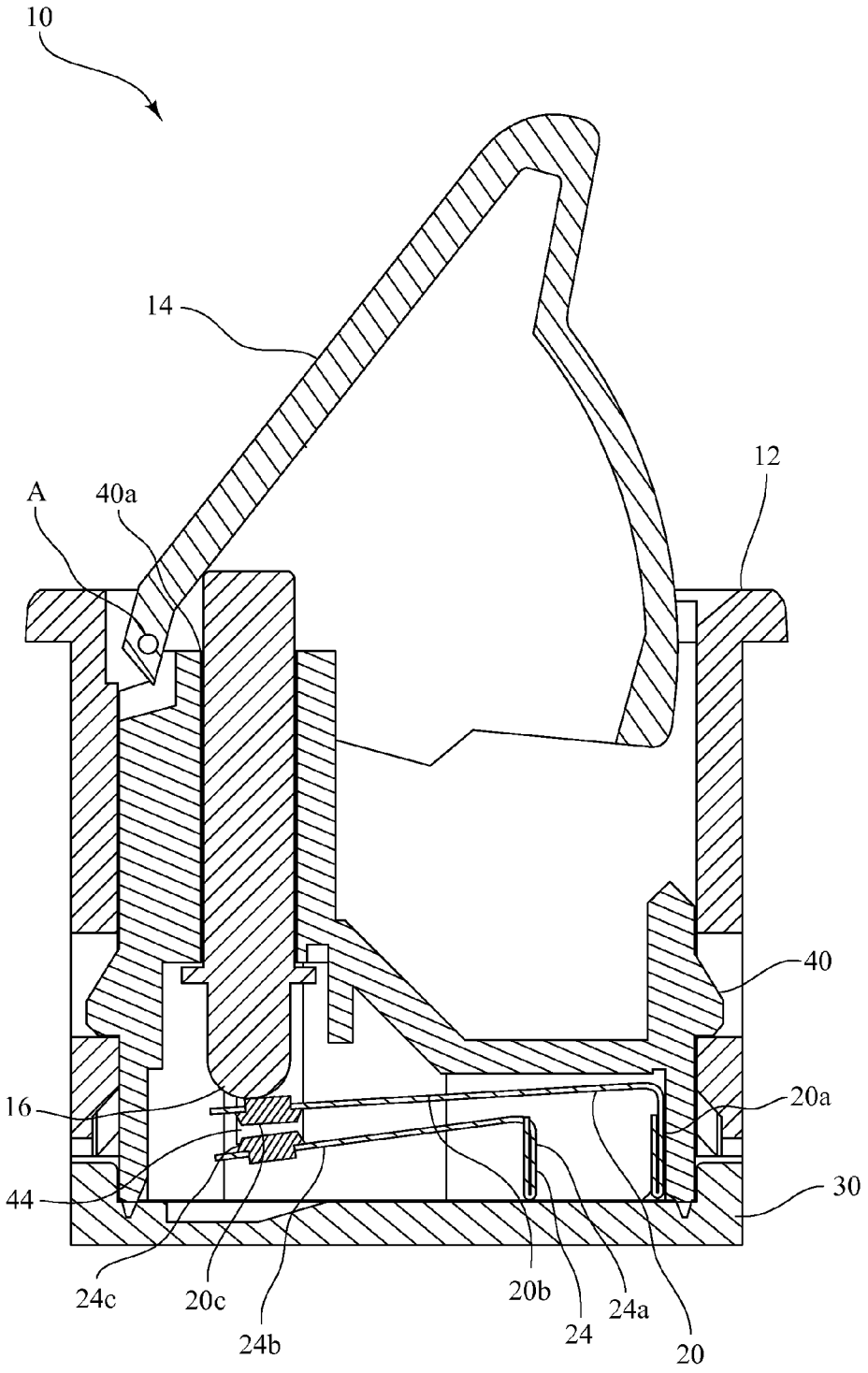
FIG. 4 is a side sectional view of the exemplary normally-open switch of FIG. 1, wherein the circuit is in an open position.

FIGS. 1-7 are various views of an exemplary normally-open switch 10 made in accordance with the present invention. As perhaps best shown in the sectional views of FIGS. 4 and 5, the exemplary normally-open switch 10 includes a housing 12 that defines an internal cavity in which the internal components of the switch 10 are housed. The exemplary normally-open switch 10 also includes a cover 30 that closes access to the internal cavity defined by the housing 12 of the switch 10 and a base 40 that is located within the internal cavity defined by the housing 12, the importance of which is further described below. As also best shown in the sectional views of FIGS. 4 and 5, the exemplary normally-open switch 10 further includes a push button 14 that is mounted for movement with respect to the housing 12. When the push button 14 is in an extended position (as shown in FIG. 4), a moveable terminal 20 is not in contact with a stationary terminal 24, leaving a circuit open. However, when a force is applied to the push button 14 (as indicated by arrow F in FIG. 5), the push button 14 rotates into the housing 12 about a pivot axis A. Such rotation of the push button 14 forces an internal post member 16, which extends between the push button 14 and the moveable terminal 20, to move downward. As the internal post member 16 moves downward, the distal end of the internal post member 16 engages and applies pressure to the moveable terminal 20, causing the moveable terminal 20 to make contact with the stationary terminal 24, thus closing the circuit.

In this exemplary embodiment, the moveable terminal 20 is a unitary component made from a conductive material, such as copper. However, the moveable terminal 20 can be characterized as including a first portion 20*a* that is rigidly secured within the internal cavity defined by the housing 12 and serves as a blade connector, along with a second portion 20*b* that extends from the first portion 20*a* in a cantilever arrangement. In other words, the second portion 20*b* is effectively a cantilever that is anchored to the first portion 20*a*. When a sufficient force is applied to the distal end of the second portion 20*b* of the moveable terminal 20, it will deflect and rotate downward relative to the first portion 20*a* of the moveable terminal 20 about an axis defined by the interface between the first portion 20*a* and the second portion 20*b*. Finally, with respect to the moveable terminal 20, as best shown in FIGS. 4 and 5, the moveable terminal 20 includes an enlarged contact portion 20*c* on the lower surface of the second portion 20*b*.

In this exemplary embodiment, the stationary terminal 24 is also a unitary component made from a conductive material, such as copper. The stationary terminal 24 can also be characterized as including a first portion 24*a* that is rigidly secured in the housing 12 and serves as a blade connector, along with a second portion 24*b* that extends from the first portion 24*a*. Furthermore, similar to the moveable terminal 20, in this exemplary embodiment, and as best shown in FIGS. 4 and 5, the stationary terminal 24 includes an enlarged contact portion 24*c* on the upper surface of the second portion 24*b* which is configured to contact the enlarged contact portion 20*c* of the moveable terminal 20 when the second circuit is closed (as shown in FIG. 5). Finally, in this exemplary embodiment, and as best shown in FIG. 7, the second portion 24*b* of the stationary terminal 24 is T-shaped, the importance of which is further described below.

Figure 5:
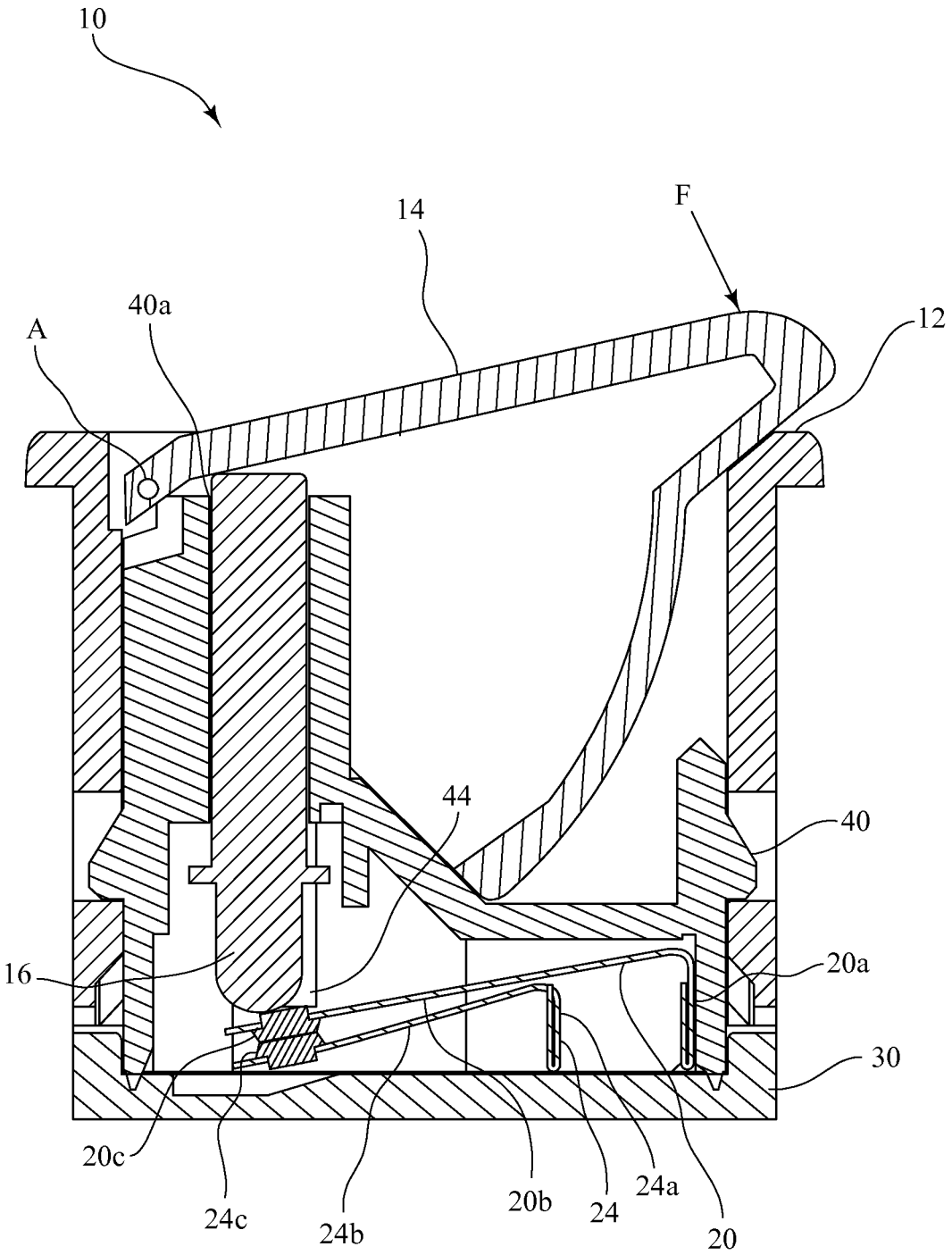
FIG. 5 is a side sectional view of the exemplary normally-open switch of FIG. 1, wherein the circuit is in a closed position.
Figure 6:
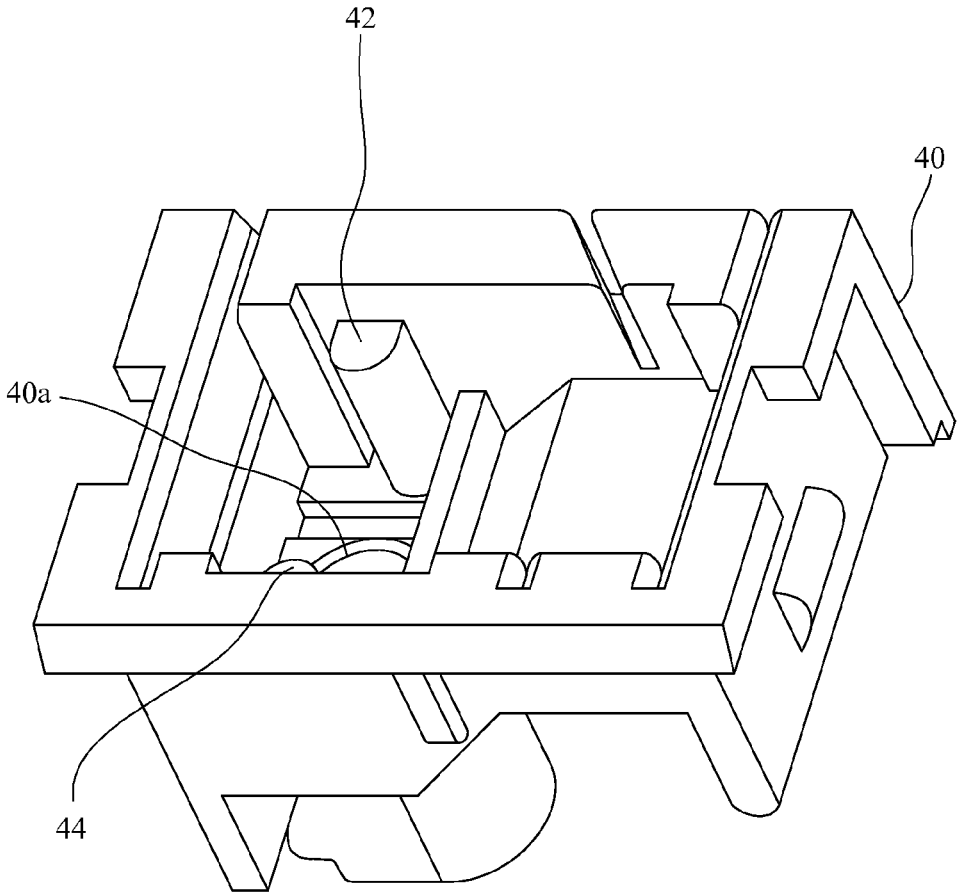
FIG. 6 is a bottom perspective view of the base of the exemplary normally-open switch of FIG. 1.

Referring once again to the sectional views of FIGS. 4 and 5, when the distal end of the internal post member 16 applies pressure to the moveable terminal 20, it causes the moveable terminal 20 to make contact with the stationary terminal 24, thus closing the circuit (as shown in FIG. 5). Once the force is no longer applied to the push button 14, the push button 14 returns to the extended position, and the moveable terminal 20 breaks contact with the stationary terminal 24, thus opening the circuit once again. In this regard, the moveable terminal 20 has sufficient resilience that it also functions like a leaf spring, providing a biasing force against the internal post member 16 that returns the push button 14 to the extended position.

Referring now to FIGS. 4-7, as previously mentioned, the exemplary normally-open switch 10 also includes a base 40 that is located within the housing 12. The push button 14 rotates toward and away from this base 40 about the pivot axis A, and the internal post member 16 passes through a channel 40*a* defined by the base 40. A pair of positive stops 42, 44 extends from an interior surface of this base 40 (as perhaps best shown in FIG. 6), with each of the positive stops 42, 44 engaging the second portion 24*b* of the stationary terminal 24 at a predetermined position in the movement of the stationary terminal 24.

Figure 7:
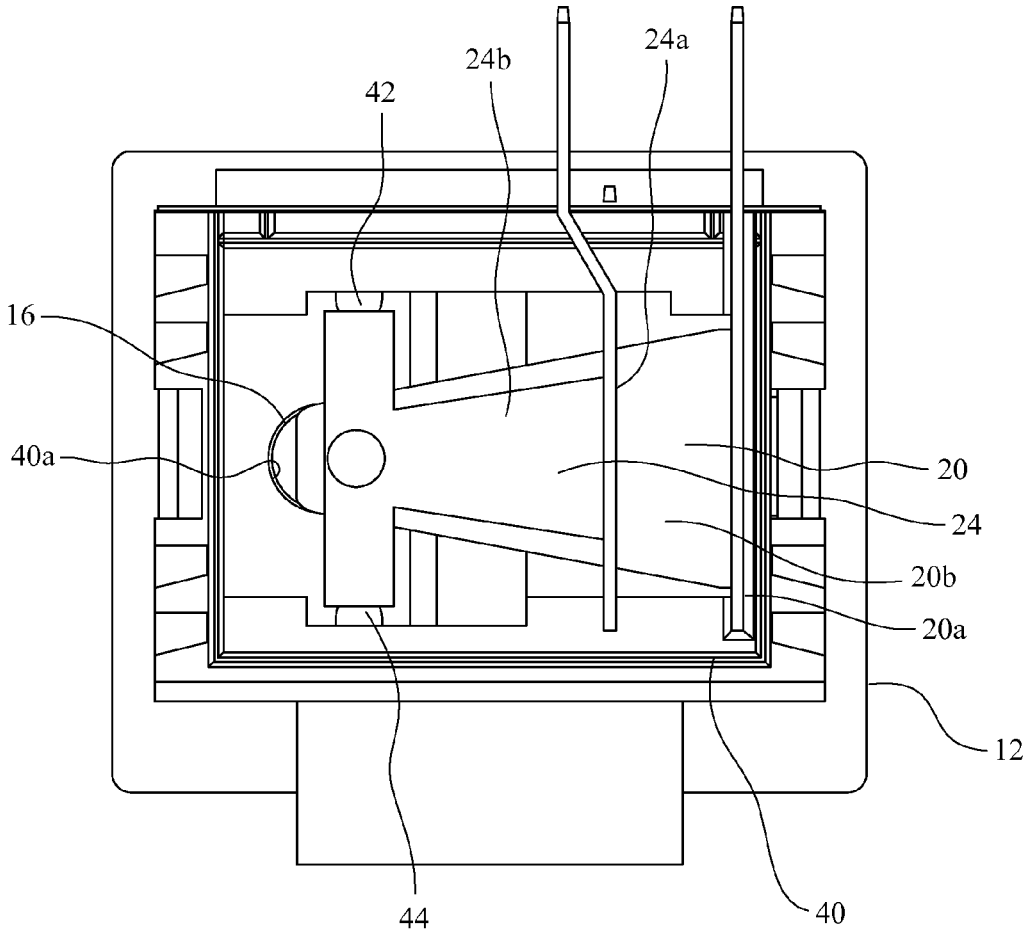
FIG. 7 is a bottom view of the exemplary normally-open switch of FIG. 1, but with the cover removed to better show the stationary terminal and the moveable terminal.

Referring still to FIGS. 4-7, in this exemplary embodiment, the positive stops 42, 44 extend from the internal sides of the base 40 and have no effect on the movement of the moveable terminal 20. In this regard, as best shown in FIG. 7, the second portion 20*b* of the moveable terminal 20 preferably has a tapered (triangular) shape, such that it can move relative to and between the positive stops 42, 44 without contacting the positive stops 42, 44. Additionally, the second portion 24*b* of the stationary terminal 24 preferably has a T-shape with a narrow central portion and a wide distal end. In particular, the wide distal end of the T-shaped second portion 24*b* of the stationary terminal 24 is wider than the distal end of the second portion 20*b* of the moveable terminal 20. Accordingly, in use, the positive stops 42, 44 apply pressure to and maintain the position of the stationary terminal 24, but do not interfere with or impede the moveable terminal 20.

When the internal post member 16 moves downward and applies pressure to the moveable terminal 20, the moveable terminal 20 makes contact with the stationary terminal 24, thus closing the circuit. When the internal post member 16 is released, and the moveable terminal 20 begins to move upward, the positive stops 42, 44 prevent any further movement of the stationary terminal 24 with the moveable terminal 20, at least beyond a predetermined position, thus breaking the circuit. In other words, the positive stops 42, 44 substantially eliminate any resistance to the disengagement of the moveable terminal 20 from the stationary terminal 24. And, as a result, the normally-open circuit opens and closes the circuit more consistently.

One of ordinary skill in the art will also recognize that additional embodiments are also possible without departing from the teachings of the present invention. This detailed description, and particularly the specific details of the exemplary embodiment disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A normally-open switch, comprising:

a housing that defines an internal cavity;

a push button that is mounted for movement with respect to the housing;

a stationary terminal;

a moveable terminal that includes a first portion that is rigidly secured in the housing and a second portion that extends from the first portion in a cantilever arrangement, wherein, when a distal end of the second portion of the moveable terminal is in contact with the stationary terminal, the moveable terminal completes a circuit; and one or more positive stops that engage the stationary terminal;

wherein, when a force is applied to the push button, the distal end of the second portion of the moveable terminal deflects and moves in a first direction, and then makes contact with the stationary terminal, thus closing the circuit;

wherein, when the force is released, the distal end of the second portion of the moveable terminal moves in a second direction opposite to the first direction, and breaks contact with the stationary terminal, thus opening the circuit; and wherein, the one or more positive stops apply pressure to and resist movement of the stationary terminal in the second direction, and thus maintain a predetermined position of the stationary terminal, but do not interfere with or impede the moveable terminal.

2. The normally-open switch as recited in claim 1, wherein the first portion of the moveable terminal serves as a blade connector.

3. The normally-open switch as recited in claim 1, wherein at least one positive stop is positioned on one side of the moveable terminal, and at least one positive stop is positioned on an opposite side of the moveable terminal.

4. The normally-open switch as recited in claim 1, and further comprising a cover that closes access to the internal cavity defined by the housing.

5. The normally-open switch as recited in claim 1, and further comprising an internal post member that extends between the push button and the moveable terminal, wherein, when the force is applied to the push button, the push button rotates and forces the internal post member to move downward and apply pressure to the moveable terminal, causing the moveable terminal to make contact with the stationary terminal, thus closing the circuit.

6. The normally-open switch as recited in claim 5, wherein the moveable terminal has sufficient resilience to provide a biasing force against the internal post member that returns the push button to an extended position.

7. The normally-open switch as recited in claim 1, and further comprising a base located within the internal cavity defined by the housing, and wherein the one or more positive stops extend from the base to engage the stationary terminal.

8. The normally-open switch as recited in claim 7, wherein at least one of the positive stops extends from the base on one side of the moveable terminal, and at least one of the positive stops extends from the base on an opposite side of the moveable terminal.

9. A normally-open switch, comprising:

a housing that defines an internal cavity;

a push button that is mounted for movement with respect to the housing;

a base located within the internal cavity defined by the housing;

a stationary terminal;

a moveable terminal that includes a first portion that is rigidly secured in the housing and a second portion that extends from the first portion in a cantilever arrangement, wherein, when a distal end of the second portion of the moveable terminal is in contact with the stationary terminal, the moveable terminal completes a circuit;

one or more positive stops extending from the base and engaging the stationary terminal;

wherein, when a force is applied to the push button, the distal end of the second portion of the moveable terminal deflects and moves in a first direction, and then makes contact with the stationary terminal, thus closing the circuit;

wherein, when the force is released, the distal end of the second portion of the moveable terminal moves in a second direction opposite to the first direction, and breaks contact with the stationary terminal, thus opening the circuit; and wherein, the one or more positive stops extending from the base apply pressure to and resist movement of the stationary terminal in the second direction, and thus maintain a predetermined position of the stationary terminal, but do not interfere with or impede the moveable terminal.

10. The normally-open switch as recited in claim 9, and further comprising a cover that closes access to the internal cavity defined by the housing.

11. The normally-open switch as recited in claim 9, and further comprising an internal post member that extends between the push button and the moveable terminal, wherein, when the force is applied to the push button, the push button rotates and forces the internal post member to move downward and apply pressure to the moveable terminal, causing the moveable terminal to make contact with the stationary terminal, thus closing the circuit.

12. The normally-open switch as recited in claim 11, wherein the base defines a channel, and wherein the internal post member extends between the push button and the moveable terminal through the channel defined by the base.

13. A normally-open switch, comprising:

a housing that defines an internal cavity;

a push button that is mounted for movement with respect to the housing;

a stationary terminal, including a first portion that is rigidly secured in the housing and serves as a blade connector, along with a second portion that extends from the first portion;

a moveable terminal, including a first portion that is rigidly secured in the housing and serves as a blade connector, along with a second portion that extends from the first portion in a cantilever arrangement, wherein, when in contact with the stationary terminal, said moveable terminal completes a circuit; and one or more positive stops that engage the second portion of the stationary terminal, wherein at least one positive stop is positioned on one side of the second portion of the moveable terminal, and at least one positive stop is positioned on an opposite side of the second portion of the moveable terminal;

wherein, when a force is applied to the push button, the moveable terminal makes contact with the stationary terminal, thus closing the circuit;

wherein the second portion of the stationary terminal has a distal end wider than a distal end of the second portion of the moveable terminal, such that the one or more positive stops engage the distal end of the stationary terminal on either side of the moveable terminal, such that the moveable terminal can move relative to and between the one or more positive stops without contacting the one or more positive stops; and wherein, the one or more positive stops apply pressure to and maintain a predetermined position of the second portion of the stationary terminal, but do not interfere with or impede the moveable terminal.

14. The normally-open switch as recited in claim 13, wherein the second portion of the moveable terminal has a tapered shape, such that it can move relative to and between the positive stops without contacting the positive stops.

15. The normally-open switch as recited in claim 13, and further comprising a base located within the internal cavity defined by the housing, wherein the one or more positive stops extend from the base and engage the second portion of the stationary terminal.

* * * * *